US006576003B2

(12) United States Patent
Kotack

(10) Patent No.: US 6,576,003 B2
(45) Date of Patent: Jun. 10, 2003

(54) THERAPEUTIC SLIPPER FOR RETAINING HEAT OR COLD AND METHOD OF FABRICATING SAME

(76) Inventor: Allan Kotack, 856 Syer Drive, Milton, Ontario (CA), L9T 4G1

( * ) Notice: Subject to any disclaimer, the term of this patent is extended or adjusted under 35 U.S.C. 154(b) by 0 days.

(21) Appl. No.: 09/945,608

(22) Filed: Sep. 5, 2001

(65) Prior Publication Data

US 2002/0038098 A1 Mar. 28, 2002

Related U.S. Application Data

(60) Provisional application No. 60/240,420, filed on Oct. 16, 2000.

(30) Foreign Application Priority Data

Sep. 25, 2000 (CA) ..... 2320672

(51) Int. Cl.[7] ..... A61F 7/00; A43B 7/02

(52) U.S. Cl. ..... 607/111; 36/2.6; 601/15; 602/2

(58) Field of Search ..... 602/5, 2, 23, 27, 602/60–62, 65; 607/108, 111, 114; 36/2.6, 136, 132, 9 R; 601/15

(56) References Cited

U.S. PATENT DOCUMENTS

| | | | | |
|---|---|---|---|---|
| 5,050,598 A | * | 9/1991 | Tucker | 607/111 |
| 5,300,104 A | * | 4/1994 | Gaudreault et al. | 607/114 |
| 5,339,541 A | * | 8/1994 | Owens | 36/2.6 |
| 5,357,693 A | | 10/1994 | Owens | |
| 5,476,492 A | * | 12/1995 | Unrug | 607/114 |
| 5,571,155 A | * | 11/1996 | Bastille | 607/114 |
| 5,591,221 A | | 1/1997 | Owens | |

* cited by examiner

*Primary Examiner*—Danton D. DeMille
*Assistant Examiner*—Quang D. Thanh

(57) ABSTRACT

A therapeutic slipper for retaining heat or cold, and that is comfortable and permits normal and comfortable walking, comprises a sole, and an upper portion disposed in overlying relation above the sole. The upper portion has compartments comprising an outer layer of material and an inner layer of material, and containing a granular temperature retentive material. Preferably, the sole is void of granular temperature retentive material. Alternatively, a pouch contains temperature-retentive granular material and is disposed within a corresponding compartment of the upper portion. A method of fabricating a therapeutic slipper is also disclosed.

6 Claims, 3 Drawing Sheets

THERAPEUTIC SLIPPER FOR RETAINING HEAT OR COLD AND METHOD OF FABRICATING SAME

This application claims the benefit of Provisional application No. 60/240,420 filed Oct. 16, 2000.

FIELD OF THE INVENTION

The present invention relates to footwear such as slippers, and more particularly to therapeutic slippers, especially those containing heat and cold retentive materials, so as to permit heating and cooling of a person's feet when wearing the slippers.

BACKGROUND OF THE INVENTION

It is a common problem for many people, especially people who experience poor circulation, or who are elderly or disabled, to have either cold feet or warm swollen feet. In either case, it is well known that externally heating or cooling the feet, as the case may be, is an effective way to return the feet to an acceptable and comfortable temperature. Various types of footwear, essentially socks, slippers or boots, for warming or cooling the feet, are known. In general, known prior art footwear is ineffective, inconvenient, cumbersome, heavy and uncomfortable, which are all serious disadvantages, particularly for the elderly and those people with muscle or circulation problems who regularly suffer from cold feet or from swollen feet.

One type of footwear is an electric sock that essentially comprises a sock that is typically made from thick woollen material, or the like, and having thin heating wires disposed within the material. These socks require a battery to be worn within a small pouch in order to heat the wires in the sock; however, the heat that is generated is typically very minimal. Further, cooling of the foot is not possible.

Other types of therapeutic footwear contain a heat and/or cold retentive material within such as a gel material, or even water. The heat and/or cold retentive material is contained within a plastic container or flexible plastic pouch, and can be heated or cooled. Specific prior art of this type will now be discussed.

U.S. Pat. No. 5,591,221 issued Jan. 7, 1997 to Owens, discloses a Therapeutic Footwear Method, U.S. Pat. No. 5,357,693 to Owens, issued Oct. 25, 1994, Discloses Footwear with Therapeutic Pad, and U.S. Pat. No. 5,339,541 issued to Owens, Aug. 23, 1994, also discloses Footwear With Therapeutic Pad. Each of these patents to Owens teaches the use of a therapeutic pad in a slipper-type article of footwear. In one embodiment, an article of footwear has an opening at the back and an elongate therapeutic pad is inserted into the slipper. One half of the elongate therapeutic pad is inserted into the left half of the slipper and the other half of the therapeutic pad is inserted into the right half of the slipper, so as to form a "U"-shape around the sides and back of the slipper. In another embodiment, the therapeutic pad is inserted into the slipper between the tongue and the top surface of the upper portion of the slipper.

U.S. Pat. No. 5,050,598 to Tucker, issued Sep. 24, 1991, discloses a Body Warming Bladder that is used in various articles, such as a slipper. The elongate bladder contains a heated liquid and is disposed along the left and right sides of the slipper and around the front of the slipper. The bladder is made from a waterproof material and is formed from two sheets secured together around the peripheral edges by heat sealing or a suitable adhesive. A cap closure closes over a filling opening in the front of the bladder.

It is also known that a slipper-like boot is available on the market, as manufactured and marketed by C.I.M. Gifts, of Forest, Ontario, Canada. This slipper-like boot is believed to be a single piece of cloth material having a central compartment containing a large quantity of grain and with two ends of the cloth material folded over and partially stitched together to form the slipper-like boot shape. This slipper-like boot has a number of drawbacks including the fact that the main pouch generally forms the sole of the slipper and therefore the wearer is walking on most of the grain, which is highly undesirable especially for the elderly or the disabled. Further, because there is only a single pouch, the grain is not disposed on top of the wearer's foot. Accordingly, this slipper type boot cannot readily be worn around while walking, and does not do an overly effective job of keeping a person's foot warm or cold, as desired, due to the lack of a heated material and/or an insulating material anywhere but below the wearer's foot.

The above stated disadvantages can be overcome with footwear comprised of compartments or pockets that are filled with a temperature-retentive granular material, (e.g. natural grain) such that the footwear can be heated or cooled. Compartments give form, structure and shape to the footwear.

It is an object of the present invention to provide a therapeutic slipper that can be worn comfortably while walking.

It is an object of the present invention to provide a therapeutic slipper that warms or cools the entire upper surface of the foot.

It is another object of the present invention to provide a therapeutic slipper that warms or cools the entire upper surface of the foot evenly.

It is yet another object of the present invention to provide a therapeutic slipper that does not leak the liquid material.

It is a further object of the present invention to provide a therapeutic slipper that is easy and inexpensive to manufacture.

It is still a further object of the present invention to provide a therapeutic slipper that permits walking in a normal and comfortable manner.

SUMMARY OF THE INVENTION

In accordance with one aspect of the present invention, there is disclosed a novel therapeutic slipper for retaining heat or cold. The therapeutic slipper comprises a sole, and an upper portion disposed in overlying relation above the sole. The upper portion has a plurality of compartments, with each compartment comprising an outer layer of material and an inner layer of material, and with at least two of the compartments containing a temperature-retentive granular material.

In accordance with another aspect of the present invention, there is disclosed a novel therapeutic slipper for retaining heat or cold. The therapeutic slipper comprises a sole and an upper portion disposed in overlying relation above the sole. The upper portion has at least one compartment, with each compartment comprising an outer layer of material and an inner layer of material, and with the at least one compartment containing a quantity of temperature-retentive granular material. The sole is void of compartments containing a temperature-retentive granular material.

In accordance with another aspect of the present invention, there is disclosed a novel therapeutic slipper for retaining heat or cold. The therapeutic slipper comprises a sole and an upper portion disposed in overlying relation above the sole. The upper portion has a plurality of compartments, with each compartment comprising an outer layer of material and an inner layer of material. At least one pouch contains a quantity of temperature-retentive granular material, with the at least one pouch being disposed within a corresponding compartment of the upper portion.

In accordance with yet another aspect of the present invention, there is disclosed a novel method of fabricating a therapeutic slipper that retains heat or cold. The method comprising the steps of: (a) forming a sole having a perimeter; (b) forming an upper portion having a plurality of compartments with each compartment comprising an outer layer of material and an inner layer of material, and the at least one compartment containing a temperature-retentive granular material; (c) attaching the upper portion to the sole so as to form an interior pocket to accommodate a wearer's foot, and such that a gap temporarily remains between the sole and one of the outer layer of material and the inner layer of material for each compartment, each the gap permitting the ingress of temperature-retentive granular material into the respective compartment; (d) adding a quantity of temperature-retentive granular material into each compartment; and, (e) closing each gap to preclude the escape of temperature-retentive granular material from the respective gap.

The therapeutic slipper according to the present invention comprises cloth footwear that can be heated in the microwave or cooled in a freezer and then worn to keep the feet and toes either warm or cool while freely walking about or sitting or lying down. The therapeutic slipper can be placed in the microwave oven for approximately 2–3 minutes, depending on the power of the microwave oven, or in the freezer for approximately 3–4 hours, depending on the temperature of the freezer, and also depending on the size of the slipper and temperature needs of the wearer. The footwear remains warm or cool for 30–40 minutes depending on the length of time in the microwave or freezer and the foot itself remains warm or cold even longer. The therapeutic slipper comprises compartments (pockets or sections) that contain a natural grain that has a particular property of retaining heat or cold for extended periods of time. The compartments and the associated support stitching, and also the selection of material, result in comfortable, flexible and effective therapeutic footwear. This therapeutic slipper is intended primarily to help the elderly who quite often have circulation problems causing cold feet, people with various illnesses and disabilities causing cold feet and those who need a cold application to relieve an inflamed foot.

Accordingly, one aspect of the present invention provides a therapeutic slipper intended to warm or cool the foot. This unique slipper combines the advantages of a heat/cold pad but with the mobility, comfort and flexibility of the slipper. The slipper contains a natural grain that retains heat or cold when placed in a microwave or freezer for a specific period of time. Compartments or pockets make up the slipper and contain the grain. The compartments are positioned in the slipper to provide maximum heat or cold distribution to specific, sensitive areas of the foot. This also enables more uniform, consistent heat or cold distribution throughout the slipper. The grain is allowed to move freely within each compartment of the slipper and the grain is prevented from shifting from one end of the slipper to the other, thereby providing consistent, focused heat or cold application. The compartments enable structure, support and firmness to the slipper making it more upright and therefore easy to wear and comfortable. Without the compartments the grain would settle to the bottom and would make it almost impossible to place the slipper on the foot. The size of the compartments dictates the quantity of grain in the slipper. The correct amount of grain is required to ensure proper heat or cold absorption and retention of same.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

The novel features which are believed to be characteristic of the therapeutic slipper for retaining heat or cold and method of fabricating same according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF A PREFERRED EMBODIMENT

Figure 1:
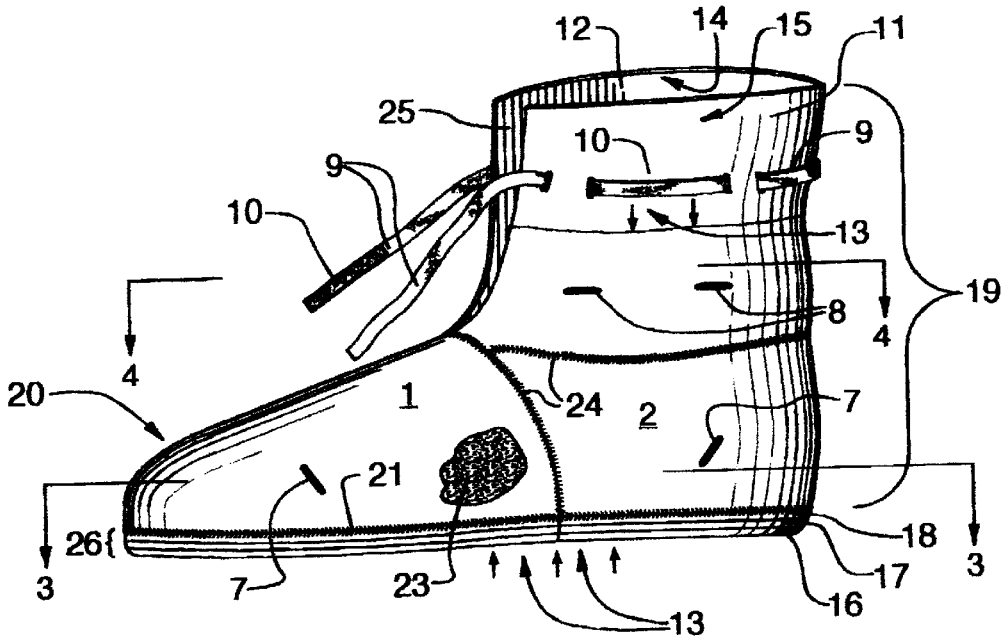
FIG. 1 is a side elevational view of a preferred embodiment of the therapeutic slipper according to the present invention.
Figure 2:
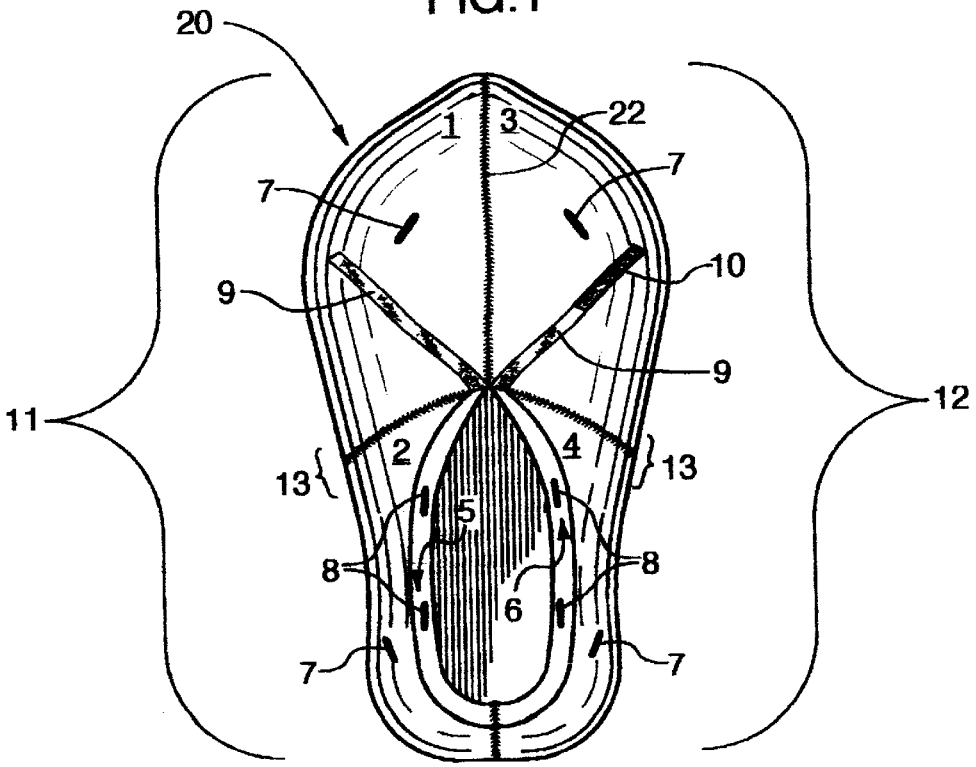
FIG. 2 is a top plan view of the preferred embodiment therapeutic slipper of FIG. 1.

Reference will now be made to FIGS. 1 through 4, which show a preferred embodiment of the therapeutic slipper of the present invention, as indicated by general reference numeral 20. The therapeutic slipper 20 is for retaining heat or cold, as desired, depending on whether the therapeutic slipper 20 is heated in a microwave or cold in a refrigerator or freezer, before being worn.

The therapeutic slipper 20 comprises a sole 26 that in the preferred embodiment, as illustrated, is void of any temperature-retentive granular material 23. In other words, the sole 26 is constructed for walking on comfortably, and in a normal 20 manner, and is not constructed for providing a heating or cooling affect on the wearer's foot.

An upper portion 19 is disposed in overlying relation above the sole 26, and is secured to the sole 26 by means of stitching 21. The upper portion comprises a left side portion 11 and a right side portion 12, as can be best seen in FIG. 2. The left side portion 11 and the right side portion 12 are preferably joined together by means of stitching 22, but may also be integrally formed one with the other.

The upper portion 19 has at least one compartment, with the left side portion 11 and the right side portion 12 each comprising a first compartment and a second compartment. In the preferred embodiment, as illustrated, the therapeutic slipper has a left front compartment 1, a left rear compartment 2, a right front compartment 3, a right rear compartment 4, a left ankle compartment 5, and a right ankle compartment 6.

Each of the compartments 1 through 6 comprises an inner layer of material (the lining 14) an outer layer of material (the facing material 15) joined together by stitching 24 at their perimeters, thus forming the respective compartments 1 through 6. In the preferred embodiment, as illustrated, each of the front left compartment 1, the rear left compartment 2, the front right compartment 3, and the right rear compartment 4 contain quantity of temperature-retentive granular material 23 therein, with the temperature-retentive granular material 23 preferably comprising a natural grain, such as oats, wheat, or the like.

The temperature-retentive granular material 23 is thermally responsive to microwave energy, so as to permit the therapeutic slipper 20 to be warmed in a microwave oven. It has been found that natural grain containing moisture therein is a suitable temperature-retentive granular material 23.

In order to keep the temperature-retentive granular material 23 substantially evenly distributed throughout the front left compartment 1, the rear left compartment 2, the front right compartment 3, and the rear right compartment 4, each of these four compartments 1 through 4 has at least one generally centrally located stitch that joins together the outer layer of material and the inner layer of material. If these support stitches were not present, each compartment would either have the temperature-retentive granular material 23 disposed at the bottom of the compartment but not at the top, or if enough temperature-retentive granular material 23 was added to each compartment to keep it filled, the compartment would be very thick and the therapeutic slipper 20 would be unduly heavy.

As can be best seen in FIG. 1, the therapeutic slipper 20 further comprises a separating slit 25 between the left and right ankle compartments disposed at the front thereof. This separating slit 25 permits ready insertion of a wearer's foot into the therapeutic slipper 20. A cloth fastener 9 having a hook and loop fastener 10, such as that known by the trademark VELCRO™ thereon is disposed in the upper compartments to permit closing of the separating slit 25, thereby helping to keep the therapeutic slipper 20 on the foot of a wearer.

There is also disclosed a method of fabricating a therapeutic slipper 20 that retains heat or cold. The method comprises the following steps. First, a sole 26 having a perimeter is formed. The sole 26 can be made of more than one layer of material to help retain heat or cold and to add comfort. A top layer 18 can be made from any material such as cloth fabrics, foam, mesh fabrics or leather. Preferably, the top layer 18 of a sole 26 comprises a cotton base attached to a heat retentive felt material 17 as a middle layer. The footwear can accommodate the choice of an insole of the wearer to add further comfort. The sole bottom layer 16 can be non-slip material. The slipper 20 would preferably be available in adult small, medium and large sizes, and also in children's sizes, and accordingly the sole 26 would be formed to the appropriate size. Preferably, the sole 26 is void of compartments containing a temperature-retentive granular material 23.

Next, the upper portion 19 is formed, having a plurality of compartments 1 through 6, with each compartment comprising an outer layer of material 15 and an inner layer of material 14, and the at least one compartment containing a temperature-retentive granular material 23. Then, the upper portion 19 is attached to the sole 26 so as to form an interior pocket to accommodate a wearer's foot, and such that a gap 13 temporarily remains between the sole 26 and one of the outer layer 15 of material and the inner layer of material 14 for each compartment 1 through 6. Each gap 13 permits the addition of a quantity of temperature-retentive granular material 23 into the respective compartment 1 through 6. Preferably, the gap 13 temporarily remains between the sole 13 and the outer layer of material.

A quantity of temperature-retentive granular material 23 is added into each compartment each gap 13 is closed to preclude the escape of temperature-retentive granular material 23 from the respective gap.

Figure 5:
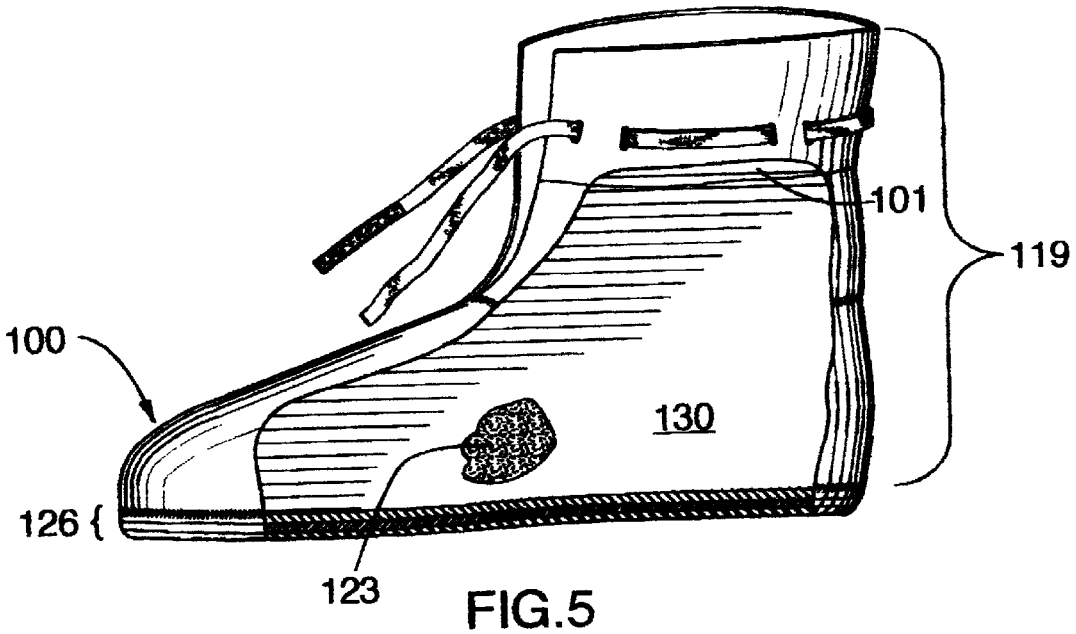
FIG. 5 is a side elevational view with a portion cut away of a first alternative embodiment therapeutic slipper according to the present invention; and, FIG. 6 is a side elevational view with a portion cut away of a second alternative embodiment therapeutic slipper according to the present invention.
Figure 3:
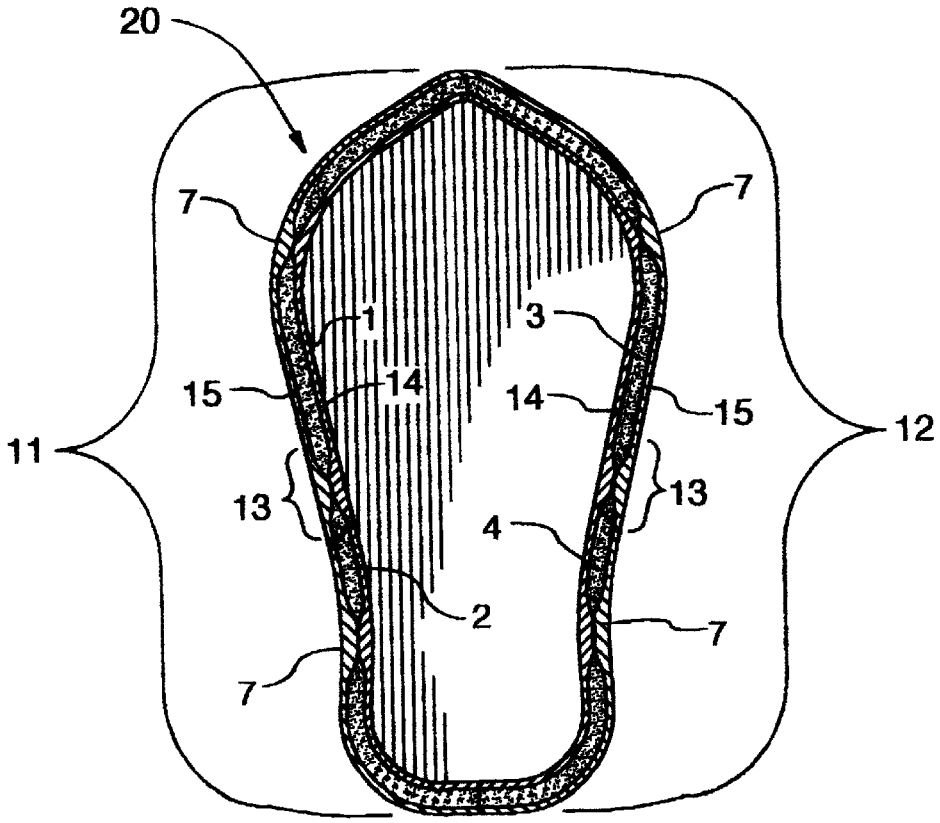
FIG. 3 is a cross-sectional top plan view taken along section line 3—3 of FIG. 2.

Reference will now be made to FIG. 5, which shows a first alternative embodiment of the therapeutic slipper 100 according to the present invention. In the first alternative embodiment, the therapeutic slipper 100 is similar to the preferred embodiment therapeutic slipper 20, in that it has a sole 126 and an upper portion 119 disposed in overlying relation above the sole 126, and with the upper portion 119 having at least one compartment 101. The therapeutic slipper 100 additionally comprises at least one pouch 130 containing a quantity of temperature-retentive granular material 123, that preferably is thermally responsive to microwave energy. The at least one pouch 130 is disposed within the corresponding compartment 101 of the upper portion 119. As illustrated, the pouch 130 is substantially flat, or in other words, its thickness is much less than its width and its length.

Figure 6:
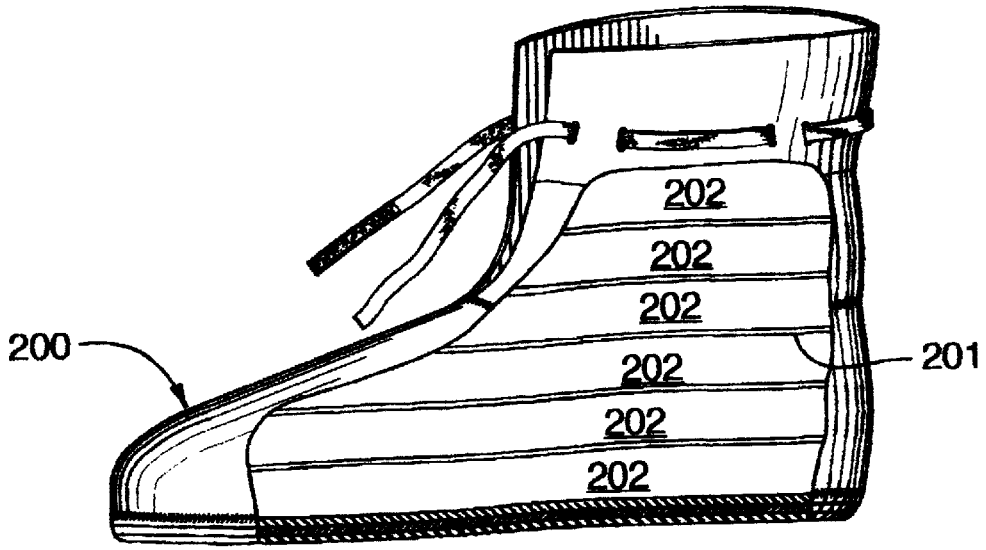
Figure 4:
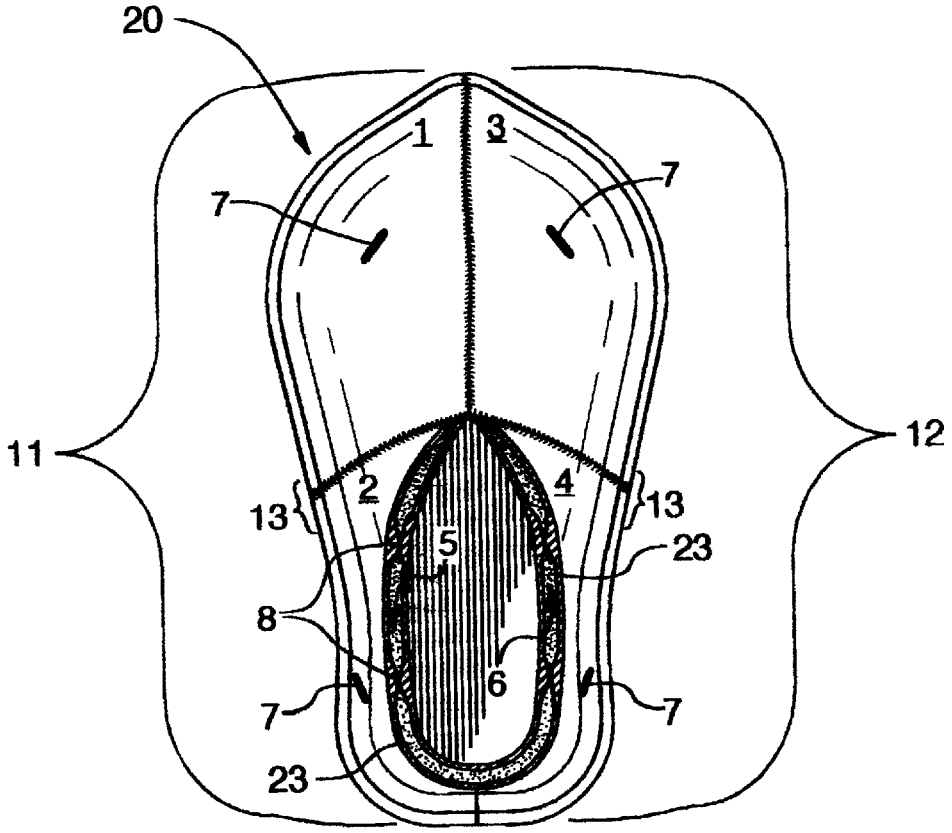
FIG. 4 is a cross-sectional top plan view taken along section line 4—4 of FIG. 2.

Reference will now be made to FIG. 6, which shows a second alternative embodiment of the therapeutic slipper 200 according to the present invention. The therapeutic slipper 200 is similar to the first alternative embodiment therapeutic slipper 100, except that the pouch 202 is substantially elongate, and is folded several times to fit into the compartment 201.

As is readily apparent from the above description, the present invention relates to a slipper comprising compartments or pockets that are filled with a natural grain such that the footwear may be heated or cooled and then worn for therapeutic purposes or simply for comfort. Preferably, the grain is a natural grain or cereal.

The grain itself provides a naturally comfortable and soothing effect. Preferably, the grain is situated near the top of and along the side the foot. The footwear may be placed in a microwave or freezer for a period of time to heat or cool the footwear, respectively. The feet and toes are kept warm or cold while walking about or while stationary. The footwear is very effective, convenient, easy to use and comfortable.

The footwear may be made from any material such as cloth fabrics, mesh fabrics or leather. The footwear may be a shoe or boot-type style. Preferably, the slipper is the boot-type. The footwear contains at least one compartment and the footwear's structure can be sewn together in a number of ways in terms of the location of the compartment. The compartments are positioned to provide maximum structure and shape to the footwear and are filled with a specific quantity of grain, depending on the size and style of the footwear. The compartments may be supported by short support stitches. The size of the compartments and the number of support stitches dictate the quantity of grain that should be in the footwear. Too many support stitches or too small compartments will limit the quantity of grain and therefore reduce the amount of heat or cold absorbed and retained.

It is preferred that the combination of the compartments and their support stitches along with the number and location of them prevent the grain from shifting, and provide the footwear with necessary structure, shape and form; minimizing the empty space in the compartments. This resulting even distribution of grain within each compartment is such that a long lasting and even application of heat or cold is provided for the foot and lower leg (if the boot-type footwear). When heated in a microwave or cooled in a freezer, the footwear, with the natural heat/cold retention properties of the grain can provide lasting relief from the discomfort of cold feet or inflammation. More preferred, the grain is in combination with a heat retentive cloth.

As can be seen in FIGS. 1 through 6, the therapeutic slipper 20 has compartments 1 to 6. Additional compartments may be required, depending on the size and style of footwear. The compartments are further supported by short support stitches 7 and 8. Additional support stitches may be required, depending on the number and size of compartments which themselves are dependent on the size and style of footwear.

Further support is provided by the cloth fastener 9. Preferably positioned above the ankle, depending on the size and style of the footwear. The fastener keeps the slipper snug around the lower part of the leg just above the ankle. The fastener keeps the footwear fitted to the foot. The fastener can be a drawstring tied like a shoelace or can be attached with hook and loop fasteners (VELCRO™) for easy fastening, as best seen in FIG. 1. The fastener could alternatively be a flap that can be pulled and attached with hook and loop fasteners (VELCRO™). Other attachment means can be incorporated to accommodate the different footwear styles in order to keep the footwear fitted around the foot or lower leg. The elderly and people with muscle problems should find this beneficial.

Depending on the size and style of the therapeutic slipper 20, in order to warm the therapeutic slipper 20, each pair should be preferably heated for 2 to 3 minutes in a microwave oven. In order to cool the therapeutic slipper 20, preferably the footwear is placed in the freezer for 3 to 4 hours. The heat/cold could be retained for 30 to 40 minutes, depending on the size and style of the footwear and the length of time in the microwave or freezer, and the intensity of the microwave or the temperature of the freezer.

Different styles of the footwear can be made while making use of compartments filled with grain. In the various embodiments illustrated in FIGS. 1 through 6, the footwear is made up of two sides 11 and 12 that are sewn together. Sides 11 and 12 are comprised of a lining 14 and the facing material 15 that are sewn together. Another embodiment could have the two sides 11 and 12 as one piece with a seam down the back. Gaps 13 are left open to each compartment between the liner and the facing material to allow the injection of grain. These gaps can be located at the most convenient position for loading of grain and subsequent sewing. The appropriate quantity of grain is injected into each compartment and the gaps are sewn closed.

The support fastener and hook and loop fasteners (VELCRO™) are added at the appropriate height, depending on the style and size of footwear.

As can be understood from the above description and from the accompanying drawings, the present invention provides a therapeutic slipper that warms or cools the entire upper surface of the foot evenly, that does not leak the liquid material, that is easy and inexpensive to manufacture, that can be comfortably worn while walking, that permits walking in a normal and comfortable manner, all of which is unknown in the prior art.

Other variations of the above principles will be apparent to those who are knowledgeable in the field of the invention, and such variations are considered to be within the scope of the present invention. Further, other modifications and alterations may be used in the design and manufacture of the apparatus of the present invention without departing from the spirit and scope of the accompanying claims.

I claim:

1. A therapeutic slipper for retaining heat or cold, said slipper comprising:

a sole; and an upper portion disposed in overlying relation above the sole, said upper portion comprises a left side portion and a right side portion joined together by means of stitching, each side portion consisting a front compartment, a rear compartment and an ankle compartment, and each compartment containing a quantity of temperature-retentive granular material;

wherein each compartment comprising an outer layer of material and an inner layer of material and having at least one generally centrally located support stitch that joins the outer and inner layers of material such that said support stitch prevents the granular material from shifting and minimizes empty spaces within each compartment, thereby having a substantially evenly distribution of said granular material throughout each compartment.

2. The therapeutic slipper of claim 1, wherein said temperature-retentive granular material is thermally responsive to microwave energy.

3. The therapeutic slipper of claim 1, wherein said temperature-retentive granular material comprises grain containing moisture therein.

4. The therapeutic slipper of claim 1, wherein said upper portion is secured to the sole by means of stitching.

5. The therapeutic slipper of claim 1, wherein said sole is void of a temperature-retentive granular material, thereby allowing said slipper to be worn comfortably while walking.

6. The therapeutic slipper of claim 1, further comprising a separate slit between the left and right side portions disposed at the front thereof.

* * * * *